US005340117A

United States Patent [19]

Wojcinski

[11] Patent Number: 5,340,117

[45] Date of Patent: Aug. 23, 1994

[54] GRANULATE - BACKSTOP ASSEMBLY

[76] Inventor: Allan S. Wojcinski, Bonifatiusstrasse 88, D-4000 Duesseldorf 11, Fed. Rep. of Germany

[21] Appl. No.: 965,749

[22] Filed: Oct. 23, 1992

Related U.S. Application Data

[63] Continuation of Ser. No. 643,539, Jan. 18, 1991, Pat. No. 5,171,020.

[30] Foreign Application Priority Data

Jan. 19, 1990 [DE] Fed. Rep. of Germany ..... 4001527
Feb. 8, 1990 [DE] Fed. Rep. of Germany ..... 4003837
Apr. 27, 1990 [DE] Fed. Rep. of Germany ..... 4013652

[51] Int. Cl.[5] ..... F41J 1/12
[52] U.S. Cl. ..... 273/410
[58] Field of Search ..... 273/410

[56] References Cited

U.S. PATENT DOCUMENTS

D. 329,680 9/1992 Burn ..... D22/113
941,642 11/1909 Maxim ..... 273/410
4,113,700 5/1992 Coburn ..... 273/410
4,294,452 10/1981 Schlotter et al. ..... 273/403
4,728,109 3/1988 Simonetti ..... 273/410
4,787,289 11/1988 Duer ..... 273/410 X
4,819,946 4/1989 Kahler ..... 273/404
4,846,043 7/1989 Langsam ..... 273/403
4,919,437 4/1990 Salabe et al. ..... 273/410
5,070,763 12/1991 Coburn ..... 273/410
5,121,671 6/1992 Coburn ..... 273/410
5,171,020 12/1992 Wojcinski ..... 273/410

FOREIGN PATENT DOCUMENTS 3131228 3/1983 Fed. Rep. of Germany ..... 273/410
3212781 10/1983 Fed. Rep. of Germany ..... 273/410

*Primary Examiner*—William H. Grieb
*Attorney, Agent, or Firm*—Merchant, Gould, Smith, Edell, Welter & Schmidt

[57] ABSTRACT

The invention relates to a backstop assembly comprising a container (1, 1', 1'', 1''') having an opening (11, 11', 11'', 11''') covered up by a medium (2) and serving as a projectile entry opening, said container containing a particulate flowable granulate (3) as a medium for slowing down projectiles.

14 Claims, 6 Drawing Sheets

50
51
51'
52
53
54
55
56
56'
56"
57
57'
58
59
60
61
62
63
64
65
66
67
68
69
VII

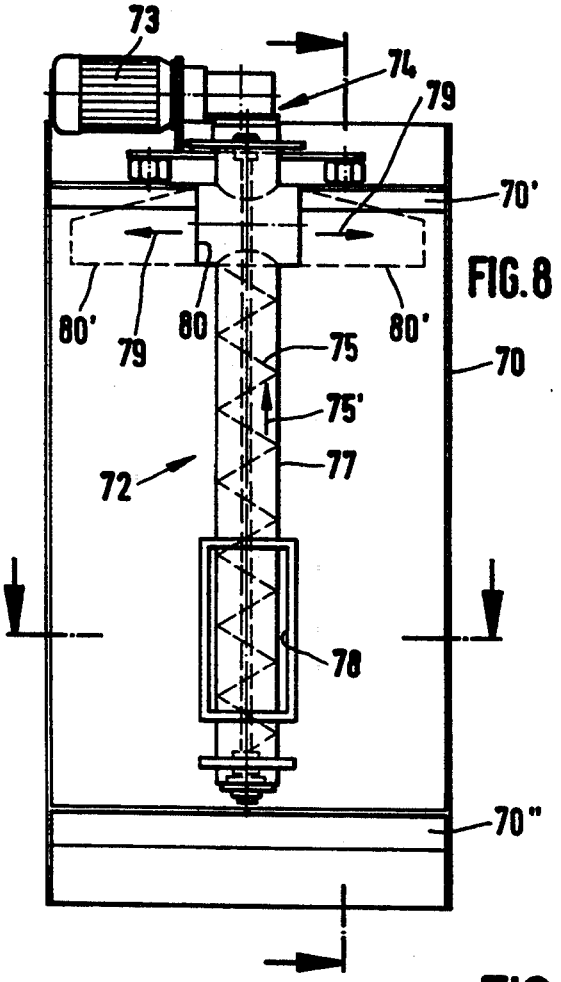
FIG.8
FIG. 9A
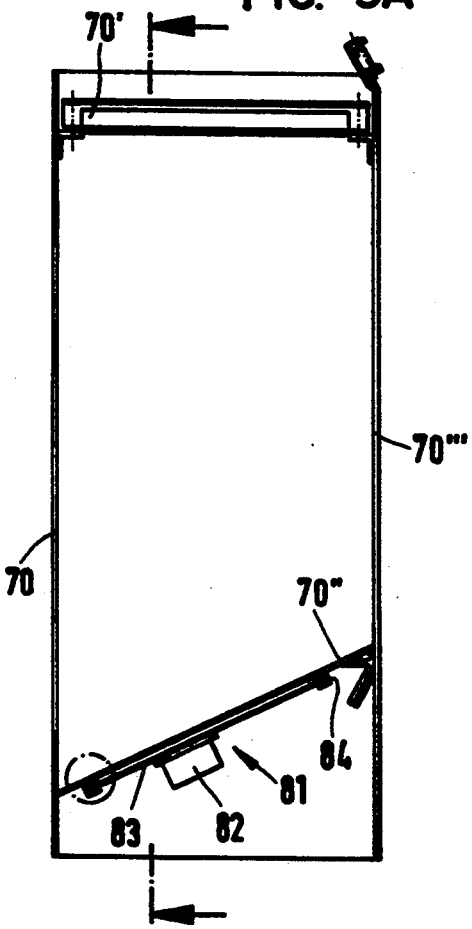
FIG. 9B
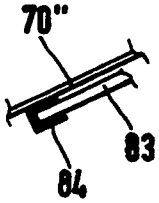
FIG.10
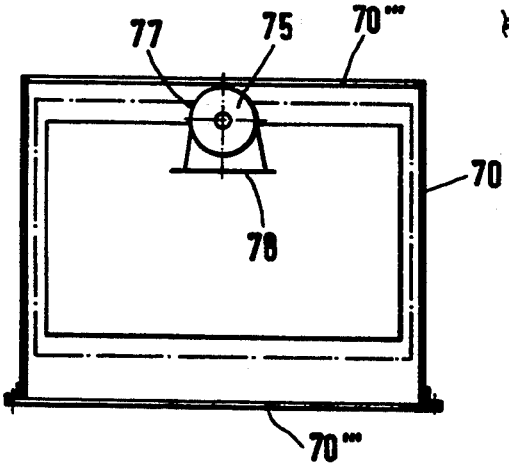

XIII
XII
90
90'
90''
90'''
91
92
93
94
95
96
97
98
99
100
101
102
103
104
105

GRANULATE - BACKSTOP ASSEMBLY

This is a continuation of copending application Ser. No. 07/643,539 filed on Jan. 18, 1991, now U.S. Pat. No. 5,171,020.

The present invention relates to a projectile backstop assembly.

A number of backstop assemblies have been known whose object is to slow down projectiles fired into them along a specified distance until they drop to the ground. For example, German Patent 31 31 228 discloses a backstop assembly in which multiple panels are vertically spaced from each other in two rows so that zigzag passages are formed between the panels of the rows where projectiles are bounced back and forth until they have slowed down enough to drop to the ground. DE-OS 32 12 781 discloses another backstop assembly wherein a container holds a granulate bonded by a bonding agent into a lumped structure, of which the objective also is to slow down projectiles fired into the granulate.

One drawback of the prior granulate-type backstop assembly is that it is difficult to, dispose since the projectiles fired into the bonded granulate are retained thereby, i.e. they become part of the bonded granulate. As a consequence, removal of the projectiles is possible only by disposing the bonded granulate together with the projectiles embedded therein. Thus the quanitites to be disposed of per unit backstop operating time are relatively high. Further, a major effort and considerable expense are needed to separate the bonded granulate from the projectiles embedded therein.

The object of the present invention is to improve on a backstop assembly of the kind specified above so that it may be disposed in a simpler and more efficient manner.

The essential advantage of the inventive backstop assembly is that it is simple to dispose. In particular, the granulate may be separated in an extremely simple and efficient manner from the slowed-down projectiles included therein. As a consequence, the projectiles or projectile fragments may be recovered very simply and reconditioned and further processed. At the same time the granulate so reconditioned may be re-used in the backstop assembly. The overall operating costs of the inventive backstop assembly are greatly reduced since the granulate used as a slowing down medium may be re-used and the quantities ultimately to be disposed of, i.e. the projectiles removed from the backstop assembly, are much smaller. Further, the inventive backstop assembly does not involve the outages needed in prior assemblies to replace the slowing-down media (rubber louvers or bonded granulate) used therein.

Another essential advantage of the inventive backstop assembly is that it may be designed for any type of ammunition. Specifically, it is only the length of the assembly in the direction of projectile entry which needs to be adapted to the kind of ammunition or caliber. For example, a length of approx. 40 cm will be selected for hand weapons; a backstop assembly suited for long arms is approximately 80 cm long.

Advantageously, the inventive backstop assembly may be constructed in any size depending on its specific use.

Since the projectiles or projectile fragments remain in the granulate and are separated therefrom by special measures, they cannot impair the environment of the backstop assembly.

Advantageous further developments of the present backstop assembly are specified in the dependent claims.

Below, the inventive backstop assembly and modifications thereof will be explained under reference to the Figures.

FIG. 8 is a sectional view of the invention;

FIG. 9 is a sectional view of the invention;

FIG. 10 is a sectional view of the invention;

Figure 1:
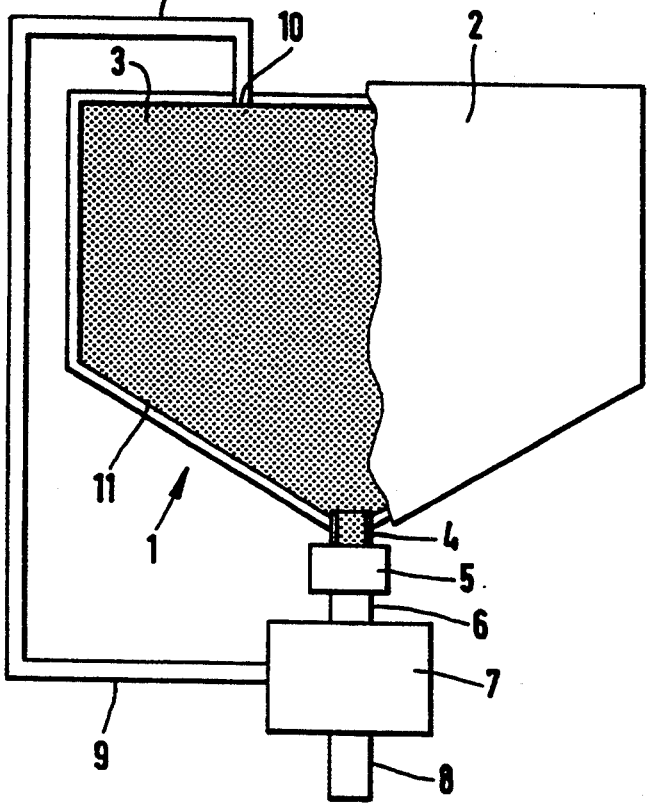
FIG. 1 shows a schematic view partly in section of the structure of the inventive backstop assembly.

As shown in FIG. 1, the present granulate backstop assembly substantially comprises a preferably box-like container 1 having on one side, which is located behind a target surface, an opening 11 closed by a preferably disklike medium 2 through which the projectiles fired towards the target area may pass. Medium 2 preferably comprise a rubber sheet. Because of the rubber material's inherent elasticity, the holes formed in rubber sheet 2 as the projectiles penetrate it close automatically when the projectiles have passed completely through sheet 2. Rubber sheet 2 is preferably mounted in front of opening 11 in such a manner that it closes opening 11 like a wall panel.

Container 1 has therein a granulate 3, which generally comprises a particulate flowable soft material capable of slowing down the projectiles fired into container 1 through rubber sheet 2, such slowing-down taking place along length L (FIG. 2) of container 1. Granulate 3 preferably consists of a particulate rubber material having an exemplary particle size of approx. 6 mm; a material of this kind is commercially available as a waste product.

In the operation of the present backstop assembly, the projectiles fired towards the target area disposed in front of rubber sheet 2 penetrate the latter. On the way along distance L of container 1, granulate 3 slows the projectiles down. For disposing of the contents of container 1 after some time, it is necessary merely to discharge granulate 3 and the projectiles and projectile fragments-therein and to fill container 1 with fresh granulate 3. To this end, container 1 may have a discharge opening such as the pipe-shaped opening 4 shown in FIG. 4 and a fill opening (net shown) e.g. in the top container wall. The projectiles and projectile fragments contained in the discharged granulate may be removed from the latter in a simple known-per-se manner, as will be described in greater detail below.

Figure 2:
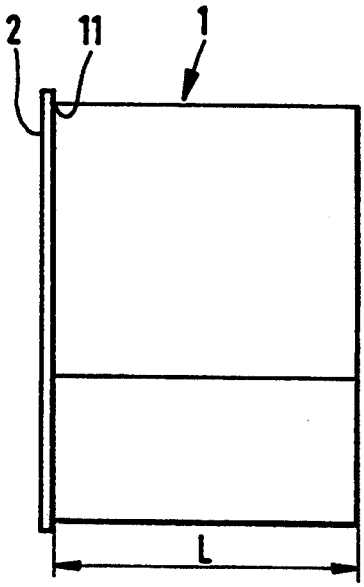
FIG. 2 shows a side view of the container of the backstop assembly of FIG. 1.
Figure 3:
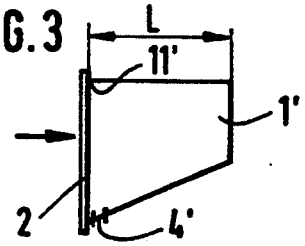
FIG. 3 is a sectional view of the invention.
Figure 4:
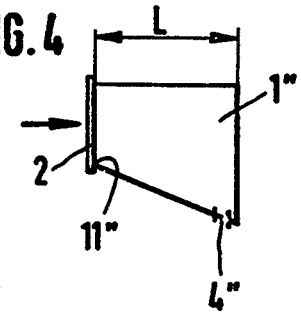
FIG. 4 is a sectional view of the invention.

FIG. 1 to 4 show preferred embodiments of the container. As shown in FIG. 3, the container is box-like in shape, with rubber sheet 2 forming the front wall of container 1′ and closing opening 11′ defined by the sidewalls, the top wall and the bottom wall. On its side opposite rubber sheet 2, the container is sealed by a rear wall. The bottom wall of the container starts at the bottom end of the rear wall and slopes downwardly towards rubber sheet 2 so that the lowermost point of the container lies about where the bottom wall meets rubber sheet 2. A granulate discharge opening 4' is located in that same area. The container of FIG. 4 is similar in construction to that of FIG. 3—apart from the fact that the bottom wall starts at rubber sheet 2 and slopes downwardly towards the rear wall so that the lowest point of container 1" lies about where the rear wall meets the bottom wall. Preferably, a discharge opening 4" is located in that area. Container 1 of FIGS. 1 and 2 is box-like in shape as well, with the bottom wall of container 1 having a tapered hopper shape, with the top opening of the hopper being attached to the container walls; the bottom end of the container forms discharge opening 4. Discharge opening 4, 4', 4" preferably is formed by a short length of pipe attached to container 1, 1', 1" and is sealable by means of a cover or the like.

It should be noted that rubber sheet 2 of container 1, 1', 1" may be disposed behind a target surface or may itself form that target surface. To this end, rubber sheet 2 may be externally coated with a white material to serve as a projection screen for stationary or moving target images generated by means of a suitable projector. In the simplest case, the fired-upon granulate is disposed of in any way desired at a location separate from the backstop after having been discharged from container 1, 1', 1".

In a preferred embodiment of the present backstop assembly, the aforesaid disposal is performed automatically as shown in FIG. 1. To this end, discharge opening 4 is connected through a valve 5 with input 6 of separating means 7 having a first output connected to line 9 and a second output 8. In separating means 7, the particulate granulate 3 is separated from projectile fragments, with the latter being passed on to output 8 and the granulate being recycled to container through return line 9 and an opening 10 in a container wall.

Advantageously, separating means 7 sucks off the granulate and the projectile fragments from container 1 through opened valve 5, with separating means 7 further utilizing the difference in weight of granulate 3 and the projectile fragments to so separate them that the relatively heavier projectile fragments are passed on to output 8 and the relatively lighter granulate particles are passed on to return line 9. For example, separating means 7 may comprise a known-per-se centrifugal separator or a vacuum separator in which the particles and fragments attracted by a created vacuum are separated in such a manner that the heavier particles are passed on to output 8 and the vacuum causes the lighter particles to be drawn back to container 1 through line 9. The necessary vacuum pump may be located inside separating means 7 itself, at opening 10 in return line 9 inside the container 1 or within return line 9 itself. It is contemplated also to return the granulate particles separating means 7 has separated from the projectile fragments to container 1 via return line 9 by positive pressure.

Separation inside separating means may also be effected by the jet from a blower which carries light particles towards return line 9 and allows heavy particles to move to output 8. It is contemplated in this context to use sensors which control the jet in dependence on the nature of the particles they sense (granulate or projectiles or projectile fragments).

Figure 5:
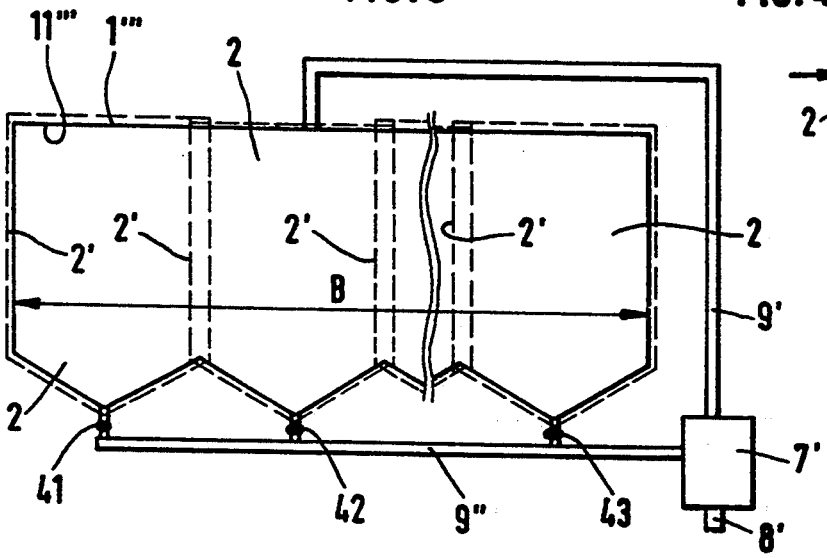
FIG. 5 is a sectional view of the invention.

FIG. 5 shows a further development of the invention in which a large projectile backstop area, which may have dimensions of 4 m by 8 m, for example, is formed by a container 1''' of which the projectile entry opening 11''' corresponds to the size of the projectile backstop area. Along width B of container 1''', several spaced granulate discharge sites are provided, which may be formed by a plurality of hopper-like sections arranged and interconnected side by side. Each discharge site is connected through a valve 41, 42, 43 with a collecting line 9" for the discharged granulate containing projectiles and projectile fragments. Collecting line 9' is connected with separating means 7' having an output 8' for projectiles and projectile fragments and an additional output connected with a return line 9' run into the interior of container 1'''. Since a rubber sheet covering all of the large-size opening 11''' is relatively expensive, opening 11''' is preferably sealed by a plurality of rubber sheets 2' placed side by side to abut at their edges or overlap in the manner shown.

The disposal scheme used for this kind of backstop assembly may advantageously be designed to take into account the extent to which the sections thereof are used for target practice within a given operating period since valves 41, 42, 43 may be opened separately in dependence on the projectile (fragment) load the associated sections of granulate 3 experience.

It is pointed out that the walls of container 1, 1', 1", 1''' preferably consist of steel. It is contemplated that at least portions thereof may be concrete walls, as may exist where the assembly is to be installed.

Figures 6, 7:
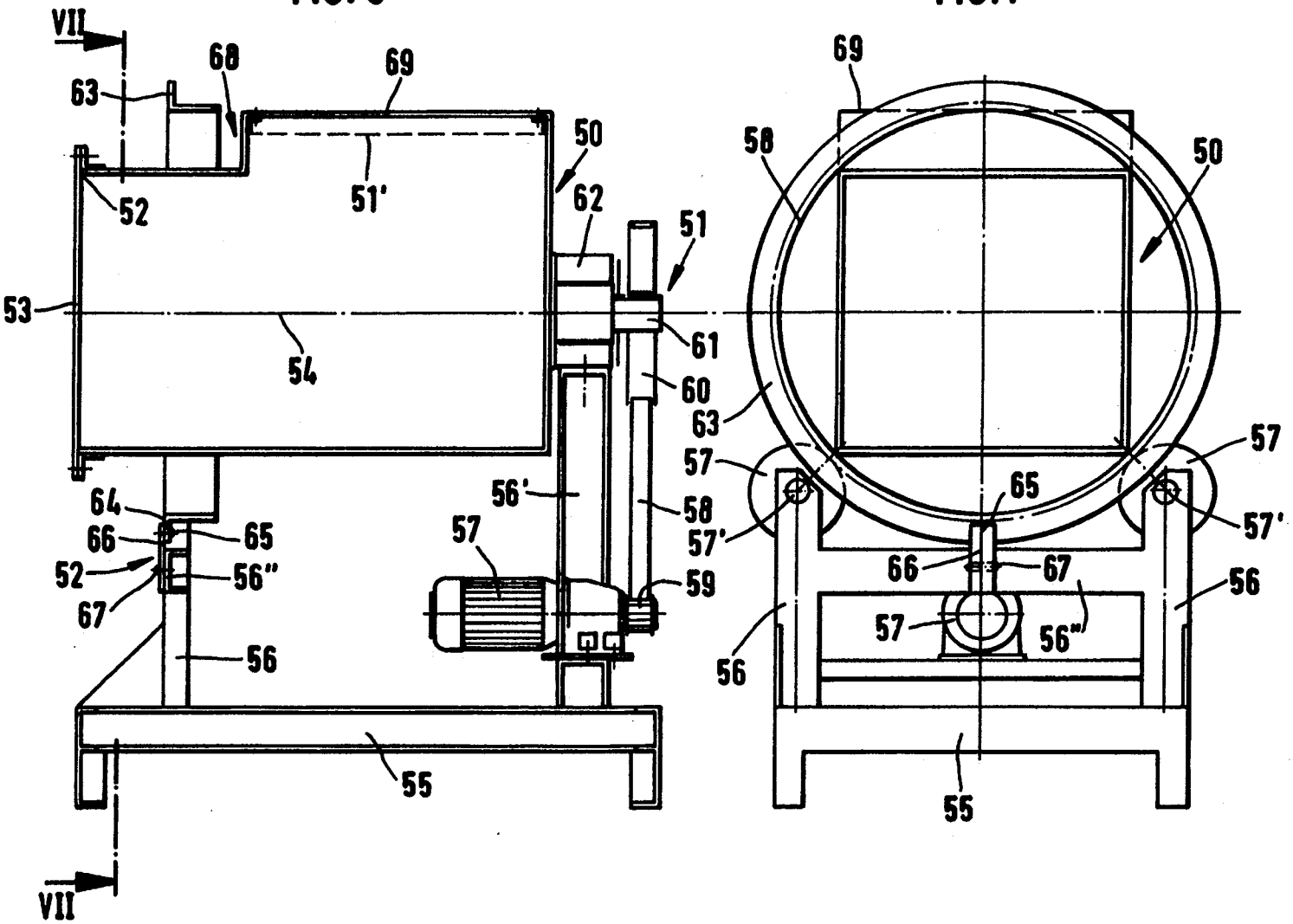
FIG. 6 is an elevational view of the invention.
FIG. 7 is an elevational view of the invention.

FIGS. 6 and 7 show a further development of the invention in which container 50 of the backstop assembly is adapted to have motion imparted thereto by means 51 in such a manner that motion is imparted also to contents of container 50, i.e. to the fired-upon granulate, so as to prevent it from lumping and to ensure that the projectiles fired into the granulate are moved from the main impact area so that newly entering projectiles cannot strike projectiles previously brought to rest by the granulate.

In the embodiment shown in FIGS. 6 and 7, means 51 is constructed to rotate container 50 about its longitudinal axis 54. These rotations keep granulate 51' from lumping; also, projectiles and projectile fragments in granulate 51' are transported away from the impact area behind entry opening 52. Entry opening 52 is sealed by a medium 53 projectiles are capable of penetrating, such as rubber sheeting.

Preferably, container 50 is rotated about its longitudinal axis 54 by being rotatably mounted in a frame preferably formed of a base plate 55 and a plurality of uprights 56', 56" extending vertically upwards from the base. In particular, two spaced uprights 56" are provided on one side of base plate 55 and each have at their free end a roll 57 mounted for rotation about an axis 57'. Rolls 57 roll on a race 58 within which container 50 is mounted preferably by race 58 being firmly connected to container 50, which is square in shape, at the four outer edges thereof (see FIG. 7). Container 50 is rotated by a drive motor 57 mounted on base plate 55 or on an upright 56 mounted along the opposite side of base plate 55, the driving power being transmitted by a toothed belt 58 trained around a pinion 59 of drive motor 57 and a driven gear 60 of container 50 to rotate the latter. Driven gear 60 is secured on a drive shaft 61 coaxial with longitudinal axis 54 of container 50 for joint rotation therewith. Drive shaft 51 is journalled in a bearing assembly 62 mounted on upright 56'.

To lock container 50 in a given position, race 58 preferably has at one end an outwardly directed annular flange 63 having an opening 64 therein to lockingly receive a bolt 65 which may be provided on a hinged plate 66 of-which the end opposite bolt 65 is rotatable about an axis 67 transverse of the longitudinal extent of bolt 65. What this means is that the plate having locking bolt 65 thereon may be rotated between positions in which bolt 65 lockingly engages or does not engage opening 64, respectively.

In the manner described and shown, container 50 may be formed on one side with an outwardly directed bulge 68 which enables the interior of container 50 to be filled with granulate to a level higher than the container wall 69 from which it extends. This way, the entire area behind projectile entry opening 52 may effectively be filled with granulate. Container 50 may have in a wall thereof—e.g. in the area of the aforesaid bulged portion 68 - a cover wall 69 to be attached to the container body by means of threaded fasteners; this cover enables container 50 to be opened for removing spent granulate therefrom and for filling fresh granulate into it. For example, container 50 may be emptied by rotating it into a position in which said cover wall 69 is in its lowermost position.

It is contemplated also to use instead of the container 50 shown, which is rectangular in shape, containers which have a circular cross section in at least portions of the periphery thereof so that the circular portion may be seated directly on rolls 57, obviating race 58.

For example, container 50 may be rotated with a speed of approximately 2 r.p.m., causing any lumps in the granulate to dissolve and projectiles or projectile particles in the granulate to be moved towards the inner container walls, thus keeping the projectile entry area clear of projectiles or projectile particles.

Plate 66, which preferably is part of a hinge assembly, is preferably mounted for rotation about axis 67 on a transverse member 56'' extending between uprights 56. It is contemplated also to provide spaced rolls similar to rolls 57, 57 on each side of container 50 and mounted on the frame, with at least one of such rolls being adapted to be driven for rotating container 50. In a design of this kind, the container may have two races (similar to race 58); alternatively, the container may have a circular cross section in the area of each pair of rolls.

Another embodiment of the invention will now be explained under reference to FIGS. 8 to 10. In this embodiment, a container 70 is similar in construction to the container explained above in connection with FIG. 4. Provided inside this container in front of rear wall 65 is an agitating mechanism 72 comprising a screw 75. Screw 75 is located in a housing 77 having an opening 78 in its bottom portion. Granulate may be fed through this opening 78 to the area in which screw 75 operates in the bottom region of housing 70. Suitably rotated, screw 75 moves the granulate previously introduced through opening 78 into housing 77 upwardly in the direction of arrow 75' and is discharged at the top end of housing 77 of agitating mechanism 72 in the direction of arrows 79 through openings 80 so as to create a steady flow of granulate.

The rubber sheet overlying the projectile entry opening is shown at 70'''.

In the manner shown in FIG. 8, a drive motor 73 rotates screw 75 through a gear box 74. Drive motor is preferably mounted on top wall 70' of container 70.

Extension tubes 80' may be attached at openings 80, as shown schematically in phantom in FIG. 8 so that the granulate is discharged at locations radially spaced from the axis of screw 75.

In order to get the projectiles or projectile fragments in the granulate to move towards bottom wall 70'', vibrating means 81 may be provided as shown in FIG. 9. Vibrating means 81 imparts vibrations to bottom wall 70'' which are transmitted to the granulate in container 70 and the projectile particles therein. Since the projectiles and projectile particles are heavier than the granulate particles, the former are moved downwards at a greater rate than the granulate so that they will accumulate in the region of bottom wall 70''. Bottom wall 70'' is sloped so that the projectiles and projectile fragments will accumulate at the lowermost point of bottom plate 70''.

Vibrating means 81 is shown schematically in FIG. 9. Exemplary components thereof are a drive assembly 82 which imparts vibrations to a vibrator panel 83 preferably through eccentric means (not shown) included in drive assembly 82. Flexible edge bars 84 are used preferably to mount vibrator plate 83 on bottom panel 70'' in such a manner that the former can vibrate relative to the latter, such vibrations being received by the flexible edge bars 84 which consist of rubber enclose the marginal areas of vibration panel 83 in a C-shaped configuration, for example. One side of the C-shaped edge bars is attached to bottom plate 70''.

Another embodiment of the invention will now be explained under reference to FIGS. 11 to 13. In this embodiment, a container 90 preferably in the form explained above under reference to FIG. 4 and having a projectile entry opening 91 covered up e.g. by a rubber sheet 92, an endless chain assembly 93 is provided to impart motion to .the granulate. Said endless chain assembly 93 essentially comprises four rolls 94, 95, 96 and 97 spaced in front of rear wall 93'' of container 93 in such a way as to lie approximately behind corners of projectile entry opening 91. The roll assemblies are conveniently mounted on rear wall 93''.

Figures 11, 12, 13:
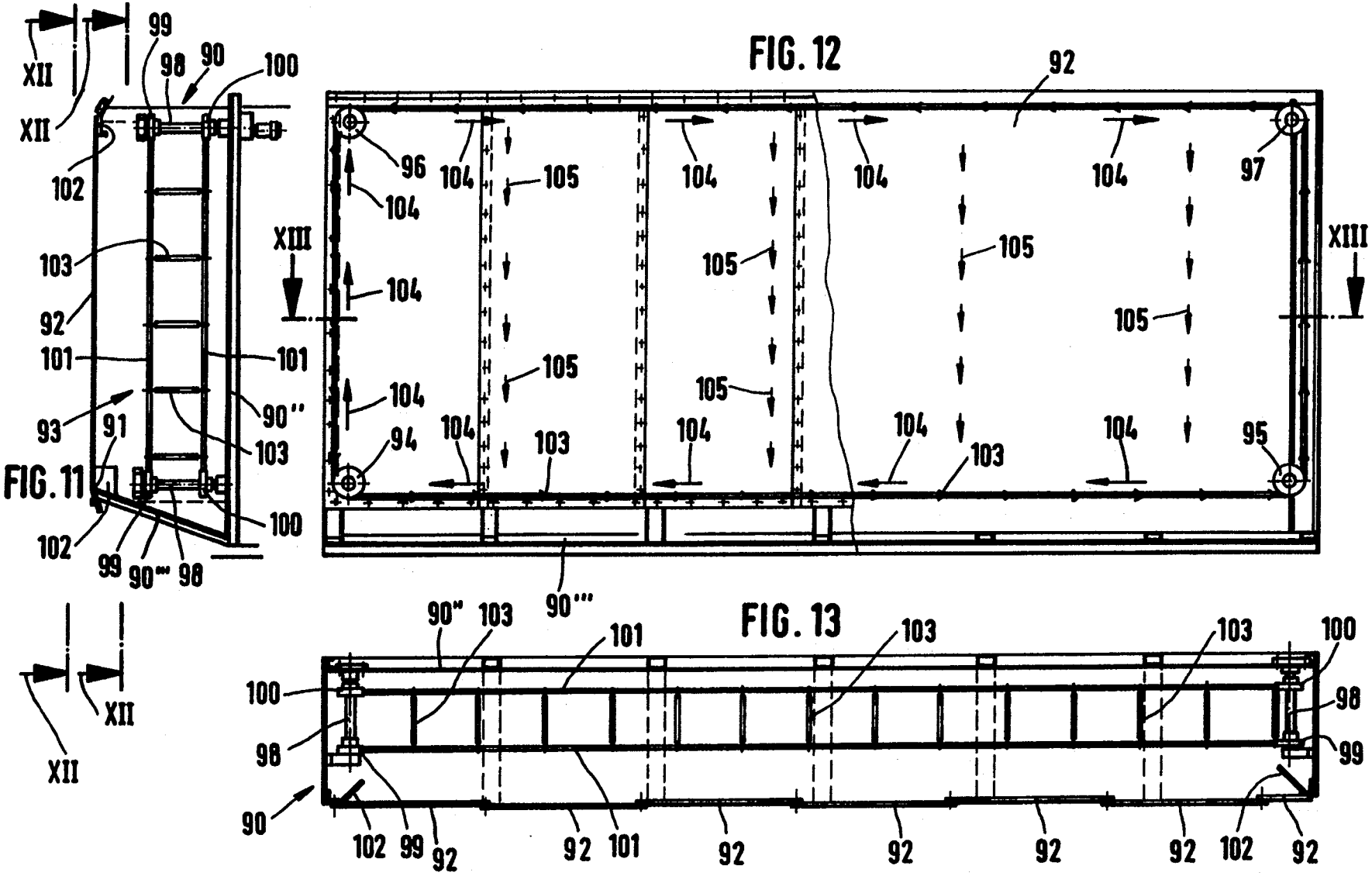
FIG. 11 is a sectional view of the invention.
FIG. 12 is a sectional view of the invention.
FIG. 13 is a sectional view of the invention.

In the example shown, each roll assembly 94 to 97 has in the manner specifically shown in FIG. 11 two spaced rolls 99, 100' mounted on one shaft 98. Rolls 99, 100 comprise sprockets around which chains 101 are trained. Since roll assemblies 94 to 95 are located approximately in the corners of projectile entry opening 91, the chains do not run through the main projectile entry region and cannot be damaged during operation of the inventive projectile backstop assembly. Roll assemblies 94 are preferably protected by steel sheet guard members 102 provided in front of them, seen in the shooting direction (see FIG. 1 specifically).

One of shafts 98 is selectively rotated by drive means; sprockets 99,100 on that shaft (FIG. 11, top righthand corner) are firmly attached thereto for joint rotation.

Spaced endless chains 101,101 are interconnected preferably in regular intervals by transverse members 103, which in the manner shown in FIG. 12 may have the shape of angled entrainment members. As the chains are circulated in a clockwise direction, the movement of chains 101, 101 and of transverse members 103 along the inner surfaces of the sidewalls, the bottom wall and the top wall of container 90 causes the granulate in the regions of the aforesaid walls of container 90 to be moved (arrows 104). In addition to this peripheral movement, the granulate particles move under gravity from the top to the bottom approximately in the direction of arrows 105 so that the projectiles and/or projectile particles contained in the granulate are moved from the top to the bottom towards bottom wall 93''' to accumulate thereat.

In the manner shown in FIG. 13, guard plates 102 may be angled to form ramps along which impinging projectiles may slide away from roll assemblies 94 to 97 into the interior regions of container 90, thus affording protection of the aforesaid roll assemblies.

It is to be noted that—instead of dual-chain assembly 93—a corresponding single-chain assembly may be used which has projecting transverse entrainment members or the like.

Figure 15:
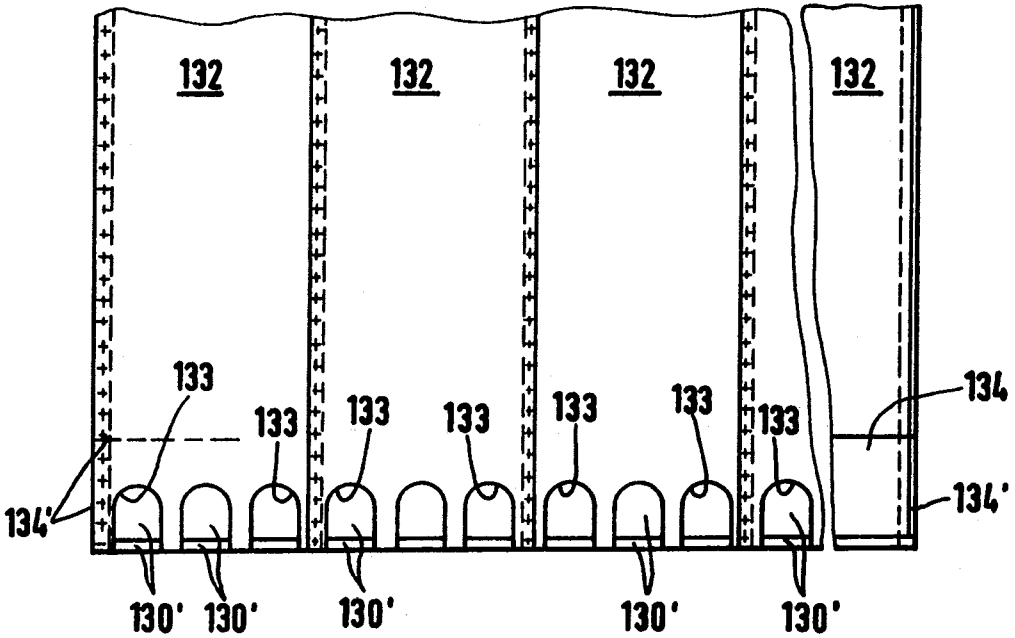
FIG. 15 is a sectional view of the invention.
Figure 14:
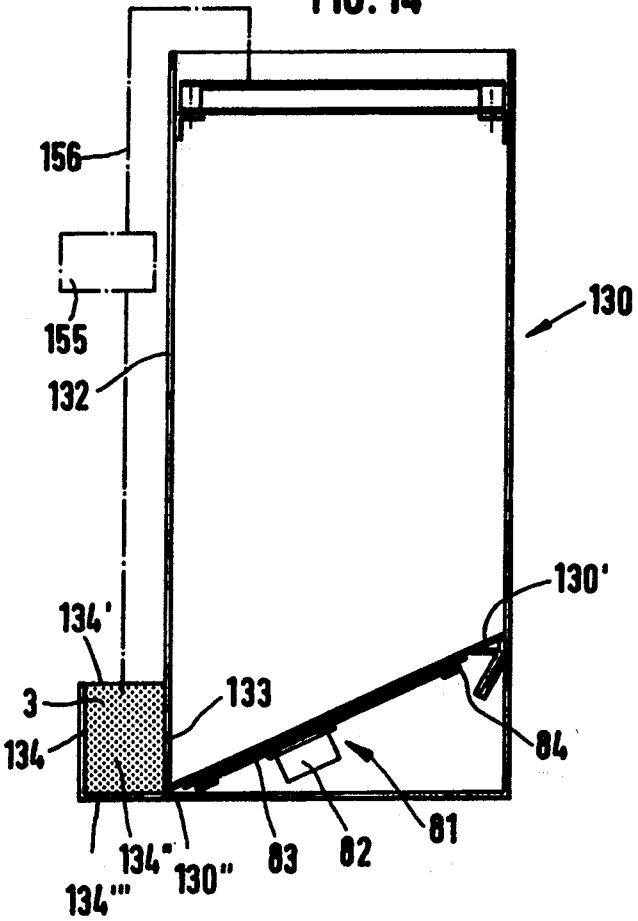
FIG. 14 is a sectional view of the invention.

In the following, another further development will be explained under reference to FIGS. 14 and 15 in which container 130 has at its bottom wall 130' the vibrating means previously discussed under reference to FIG. 9. Details of this vibrating means. previously explained under reference to FIG. 9 will therefore be identified by like numerals. Lower wall 130' of container 130 is sloped—preferably in a manner that lowermost point 130'' of container 130 lies at the front thereof, i.e. on its projectile entry side. As previously explained, the projectile entry opening of container 130 is sealed by a medium 132 preferably in the form of at least one rubber panel through which projectiles can travel and enter container 130. In the manner shown in FIG. 15, and as previously explained under reference to FIG. 12, the projectile entry opening can be formed by a plurality of laterally overlapping media or rubber sheets 132. In the lower marginal region, the at least one rubber sheet 132 of the overlapping multiple rubber sheets 132 have spaced openings 133 through which granulate 3 can enter from container 130 into region 134'' in front of openings 133 when vibrating means 81 is operated. Openings 133 have in front of them wall 134 (FIG. 14) spaced from and preferably extending parallel to rubber sheet(s) 132 on the side opposite container 130. The height of wall 134 is selected so as to at least cover up openings 133. Between the sidewalls of container 130 and wall 134 extend sidewall portions 134' (FIG. 14) which together with wall 134 and the lower portions of rubber sheets 132 and a bottom wall portion 134''' form a box-shaped cavity 134'' where granulate 3 will accumulate to a predetermined level when vibrating means 81 operates. Once the backstop assembly has been fired at, granulate 3 in cavity 134'' has projectiles and/or projectile particles dispersed therethrough.

Wall 134 is preferably made of a material which can be penetrated by the projectiles fired at the backstop assembly. One advantage of that wall is that it forms together with granulate 3 in cavity 134'' therebehind a protection for the lower steel structure (lower wall 130', frame members, etc.) since projectiles penetrating wall 134 will be slowed down in cavity 134'' before they reach any steel structural element, and this to the point that they cannot exit from cavity 134'' any longer after they have struck a said steel structural element.

The granulate 3 in cavity 134'', which has projectile fragments and/or projectiles therein, may be cleaned by the vacuum discharge and separating means previously discussed under reference to FIGS. 1 and 5. More specifically, granulate 3 and the projectile fragments therein may be sucked from cavity 134'' and passed on to separating means 155 where the projectile fragments are separated from granulate 3. Following the separating means, the cleaned granulate may be recycled to container 130 through line 156 and preferably through the top wall thereof. It is sufficient to .operate vibrating means 81 and to discharge granulate 3 from cavity 134'' for the removal of projectile fragments after a predetermined operating period such as several times a day if the backstop assembly is intensively used. In the manner described above, the projectile-loaded granulate may be removed from cavity 134'' after predetermined operating periods and suitably disposed at a site remote from container 130.

Figure 17:
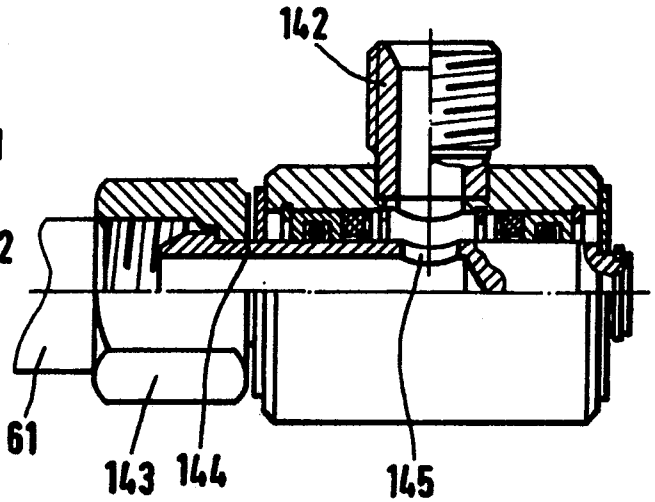
FIG. 17 is a sectional view of the invention.
Figure 16:
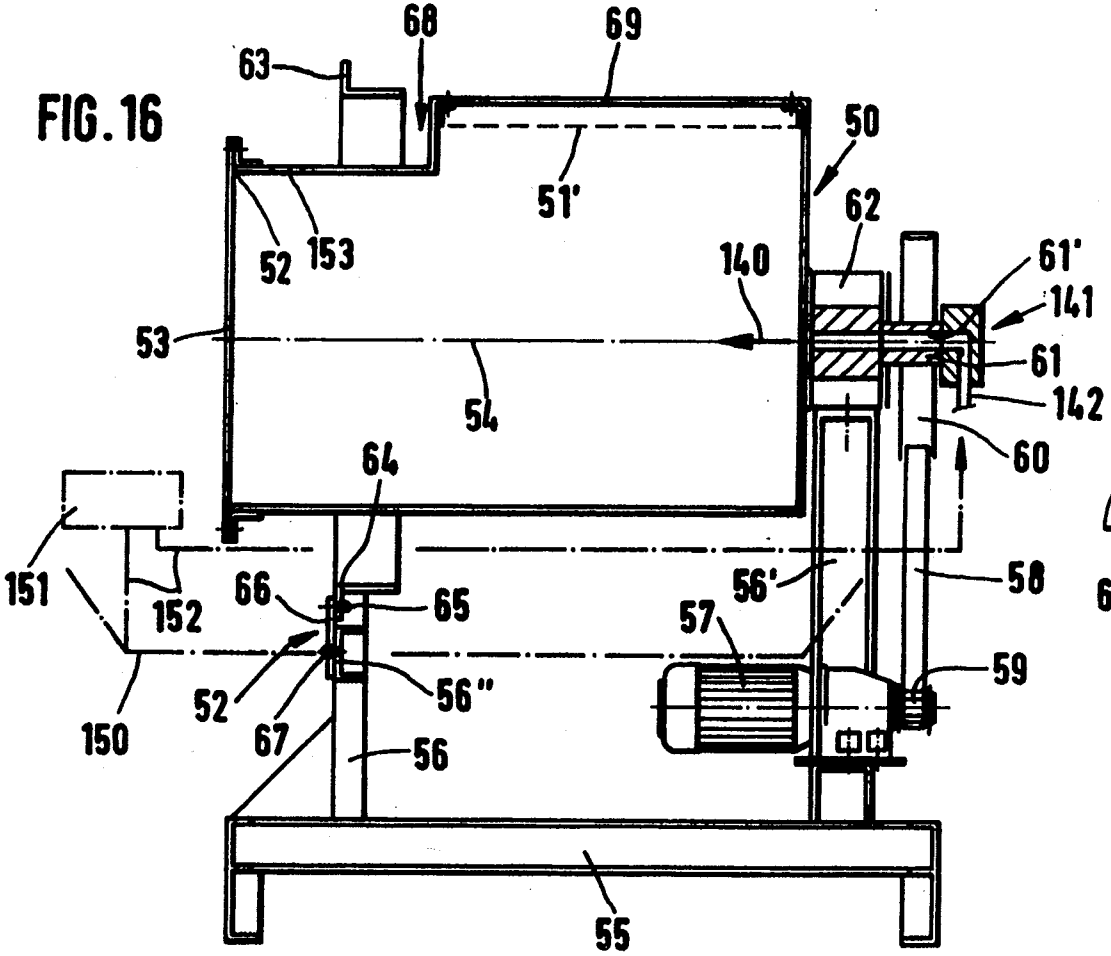
FIG. 16 is a sectional view of the invention.

There will now be explained under reference to FIG. 16 another further development of the embodiment shown in FIGS. 6 and 7, which development is suited specifically for backstopping tracer ammunition projectiles. Details of FIG. 16 previously explained under reference to FIGS. 6 and 7 are identified by like reference numerals. As tracer projectiles penetrate medium 53 and enter container 50, they may cause the particles of granulate 3 to lump or fuse. To counteract this tendency, container 50 has supplied thereto—preferably through an angled rotary union—a quenching fluid such as water. More specifically, drive shaft 61 has an inner bore 61' through which the fluid is introduced in the direction of arrow 140. On its free end, shaft 61 has an angled rotary union 141 attached thereto which communicates rotating drive shaft 61 with a supply line 142 to pipe the liquid to the point of use. Angled rotary unions of this kind are known; for example, they may be attached to rotating drive shaft 61 by means of a coupling or union nut 143 in the manner shown in FIG. 17. Union nut 143 is held on a tube 144 for rotation in a fluid-tight seal. Tube 144 communicates with supply line 142 through a opening 145. For collecting quenching fluid escaping from container 50, a collecting vessel 150 may be provided where shown in phantom in FIG. 16.; conveniently, this vessel has the form of a pan or trough 150 placed underneath container 50 particularly to catch the liquid dripping from leaks caused in medium 53 by the projectiles passing therethrough. A pump 151 and a return line 152 may be used to remove that fluid from pan 150 for return to container 50 through supply line 142. Pump 151 preferably has a reservoir so that, when the latter is full, the fluid may be discharged into container 50 through supply line 142 and bore 61'.

I claim:

1. A backstop assembly for projectiles and projectile fragments, comprised of a box-shaped container having therein an opening covered by a medium for permitting projectiles and projectile fragments to enter said container, granulate means having a particle size between 3 and 9 mm, located within said container for slowing down and capturing projectiles and projectile fragments after they have entered said container; said container having a sloped bottom wall; said container having a discharge opening for granulate, projectiles and projectile fragments proximate the lowermost portion of said bottom wall.

2. The backstop assembly of claim 1, further including vibrating means for imparting vibrations to said bottom wall of said container and wherein said vibrating means comprises drive means for imparting vibrations to a vibrator panel mounted on said bottom wall, with the vibrations of said vibrator panel being transmitted to said bottom wall.

3. The backstop assembly of claim 1, wherein said medium comprises at least one rubber sheet for covering up said opening.

4. The backstop assembly of claim 1, wherein said container is formed of walls made of steel.

5. The backstop assembly of claim 1, further including a separating means adapted to receive granulate having projectiles and projectile fragments therein, the latter being separable from the granulate in said separating means in such a manner that the granulate is transportable to a return line leading back to said container and the projectiles and projectile fragments are transportable to an output of said separating means.

6. The backstop assembly of claim 5, wherein said separating means comprises centrifuge means.

7. The backstop assembly of claim 5, wherein said separating means includes a blower for providing a jet stream to separate the relatively lighter granulate from the relatively heavier projectiles or projectile fragments.

8. The backstop assembly of claim 1, wherein the lowermost portion of said bottom wall is in the area of said medium and said medium includes at least one discharge opening in the area adjacent said bottom wall.

9. The backstop assembly of claim 8, wherein a cavity is formed in front of said at least one discharge opening by at least one wall being spaced from said medium wherein said wall is comprised of a material permitting the passage of projectiles.

10. The backstop assembly of claim 9, wherein said granulate means and any projectiles and projectile fragments therein are transportable from the cavity to separating means for separating said granulate means from said projectiles and projectile fragments therein and returning said granulate means to said container.

11. The backstop assembly of claim 1, wherein said lowermost portion of said bottom wall is at the side of said container opposite said medium.

12. A backstop assembly for projectiles and projectile fragments, comprised of a box-shaped container having therein an opening covered by a medium for permitting projectiles and projectile fragments to enter said container, granulate means located within said container for slowing down and capturing projectiles and projectile fragments after they have entered said container, said container comprising a sloped bottom wall and a discharge opening for receiving said granulate means, projectiles and projectile fragments, said discharge opening located proximate the lowermost portion of said bottom wall, the lowermost portion of said bottom wall being located proximate said medium, said medium having at least one opening in an area adjacent to said bottom wall.

13. The backstop assembly of claim 12, wherein a cavity is formed in front of said at least one discharge opening by at least one wall being spaced from said medium wherein said wall is comprised of a material permitting the passage of projectiles.

14. The backstop assembly of claim 13, wherein said granulate means and any projectiles and projectile fragments therein are transportable from said cavity to said separating means for separating the granulate means from the projectiles and projectile fragments therein and returning it to said container.

* * * * *

UNITED STATES PATENT AND TRADEMARK OFFICE

CERTIFICATE OF CORRECTION

PATENT NO. : 5,340,117

DATED : August 23, 1994

INVENTOR(S) : Allan S. Wojcinski

It is certified that error appears in the above-indentified patent and that said Letters Patent is hereby corrected as shown below:

On the title page: Item [73] after the word "Germany", please insert Caswell International Corporation, Minneapolis, MN --.

Item [30] Foreign Application Priority Data, please delete "4001527", "4003837",and "401,3652", and insert therefor --4001527.0-- --4003837.8-- --4013652.3 --.

Abstract, line 7, after the word "projectiles", please insert -- (FIG.1)--.

In column 1, line 24, please delete the words "to, dispose", and insert therefor --to dispose of--

In column 1, line 29, please delete the word "quanitites", and insert therefor --quantities--

In column 2, line 60, please delete the words "(net shown)", and insert therefor --(not shown)--

In column 3, line 48, please delete the words "to so separate them that", and insert therefor --so as to separate them, so that--

UNITED STATES PATENT AND TRADEMARK OFFICE

CERTIFICATE OF CORRECTION

PATENT NO. : 5,340,117

DATED : August 23, 1994

INVENTOR(S) : Allan S. Wojcinski

It is certified that error appears in the above-indentified patent and that said Letters Patent is hereby corrected as shown below:

In column 5, line 8, please delete the words "of-which", and insert therefor --of which--

In column 6, line 47, please delete "100'", and insert therefor --100--

In column 7, line 21, after the word "means", please delete "."

In column 7, line 35, please delete the word "of", and insert therefor --or--

Signed and Sealed this

Sixth Day of June, 1995

*Attest:*

Bruce Lehman

BRUCE LEHMAN

*Attesting Officer*

*Commissioner of Patents and Trademarks*